US006681761B2

(12) United States Patent
Dillingham

(10) Patent No.: US 6,681,761 B2
(45) Date of Patent: Jan. 27, 2004

(54) EXHAUST DAMPER SYSTEM FOR ASPHALT HEATING DEVICE

(75) Inventor: Harold W. Dillingham, Jacksonville, TX (US)

(73) Assignee: H. D. Industries, Inc., Jacksonville, TX (US)

( * ) Notice: Subject to any disclaimer, the term of this patent is extended or adjusted under 35 U.S.C. 154(b) by 69 days.

(21) Appl. No.: 10/076,007

(22) Filed: Feb. 14, 2002

(65) Prior Publication Data

US 2003/0150443 A1 Aug. 14, 2003

(51) Int. Cl.[7] ..... F23J 11/00; E01C 23/14

(52) U.S. Cl. ..... 126/343.5 A; 236/1 G; 126/312

(58) Field of Search ..... 126/343.5 A, 343.5 R, 126/312, 293, 376.1; 236/1 G, 45; 404/95

(56) References Cited

U.S. PATENT DOCUMENTS 2,548,177 A * 4/1951 Tauber ..... 126/343.5 A
2,856,992 A * 10/1958 Bartels ..... 236/1 G
5,988,935 A * 11/1999 Dillingham ..... 404/79

* cited by examiner

*Primary Examiner*—Sara Clarke
(74) *Attorney, Agent, or Firm*—Charles D. Gunter, Jr.

(57) ABSTRACT

A device is shown for transporting asphalt repair materials for use in repairing potholes in asphalt pavements. The device has a body with a hopper compartment for transporting and dispensing asphalt mix materials. A dry, radiant heat source is located in a heating chamber below the hopper compartment and heats the asphalt mix. Exhaust stacks in communication with the dry heat means have a damper system for retaining heat within the heating chamber, the damper system being electronically controlled in response to the temperature within the body of the device.

13 Claims, 4 Drawing Sheets

EXHAUST DAMPER SYSTEM FOR ASPHALT HEATING DEVICE

BACKGROUND OF THE INVENTION

1. Field of the Invention

The present invention relates generally to truck and/or trailer mounted portable devices for dispensing pavement repair materials and, specifically, to such a portable device for dispensing repair materials for asphalt pavements.

2. Description of the Prior Art

In the past, as many as three vehicles were sometimes needed to repair openings and potholes in asphalt, concrete and other roadway surfaces. One vehicle provided an air compressor for use with various pneumatic repair tools which were used to dress the hole, crack or cavity to be filled. Another vehicle contained liquid asphalt tack material which would be sprayed into the dressed cavity, and a third vehicle would deliver asphalt mix material to the cavity. The asphalt would then be packed, compacted and leveled by hand to complete the repair.

U.S. Pat. No. 4,196,827, issued Apr. 8, 1980, entitled "Portable Machine For Transporting Heated Asphalt Products For Use In Repair Asphalt Pavement" shows a portable machine which was designed to incorporate all phases of the pavement repair into one mobile unit. The machine has a hopper for transporting asphalt mix, and a reservoir below the hopper having a heat source. The reservoir contained liquid asphalt tack material. The heat source is used to heat the liquid tack material, and the tack material is used to heat the asphalt mix in the hopper by heat transfer. Asphalt tack material is also dispensed from the tack material tank by means of spray equipment connected to a discharge valve on the rear of the truck.

In spite of being less expensive to operate in terms of material and labor, the previously described device possessed several different disadvantages. For example, the liquid asphalt tank carried on the unit was suitable for road oils and cutbacks but was not well suited for use with asphaltic cements. Also, in the case of the device described in the '827 patent, the liquid asphalt tank was not suited for use with asphalt emulsions, because the volatile contents of the emulsions would be driven off and dry out the materials.

U.S. Pat. No. 4,944,632, issued Jul. 31, 1990, and assigned to the assignee of the present invention showed a portable unit with a separate tack oil tank which was provided with its own heat source and which was designed to prevent phase separation of the tack oil materials to overcome some of the deficiencies of the prior art devices. This tank could be used successfully with both emulsions and asphalt cutback oils.

Both of the prior art devices utilized a liquid heat transfer medium to heat the asphalt hopper of the device and maintain the asphalt mix materials therein in a workable state. While a liquid heat transfer medium has been used successfully for many years to heat the asphalt hopper, there are disadvantages associated with the use of a liquid medium. Many of these disadvantages relate to the release of volatile components of the medium as it is repeatedly heated during use. The liquid medium must also be maintained and/or replaced at regular maintenance intervals.

Accordingly, it is an object of the present invention to replace the liquid heat transfer medium used in the prior art to heat the hopper compartment of an asphalt repair apparatus with a dry, radiant heat source which does not require refill and which does not emit volatile organic emissions to the atmosphere.

Another object of the invention is to provide such a dry, radiant heat source for an asphalt repair apparatus which heat source safely and effectively heats the asphalt repair materials without hardening, burning or charring such materials.

Another object of the invention is to provide a means for retaining heat from the dry, radiant heat source within the device of the invention, limiting heat loss when the heat source is not operating.

Another object of the invention is to provide such an apparatus which is simple in design and economical to manufacture.

SUMMARY OF THE INVENTION

The portable apparatus of the invention is used to transport heated pavement repair materials for use in repairing roadways and other traffic bearing surfaces. The device includes a body adapted to be mounted on a portable base for transporting the body to a repair site. The body has a hopper compartment with a V-shaped bottom wall for transporting asphalt mix material and a generally V-shaped heating chamber located below the hopper compartment. The V-shaped bottom wall of the hopper compartment defines an upper extent of the heating chamber. A screw conveyor is mounted in the bottom of the hopper compartment for dispensing asphalt mix materials therefrom. An agitator, such as a paddle shaft, is located above the screw conveyor in the hopper compartment for agitating the hopper materials. A dry heat means is associated with the heating chamber for heating the chamber and for transferring heat to the hopper compartment through the hopper bottom wall to maintain the asphalt mix materials in a workable state.

Preferably, the V-shaped bottom wall of the hopper compartment forms an upper, uninsulated common wall with the heating chamber. The heating chamber also has oppositely extending, insulated bottom wall portions. In a preferred embodiment of the invention, the dry heat means comprises a pair of oppositely arranged retort tubes located within the heating chamber on either side of the V-shaped bottom wall of the hopper. The retort tubes are heated by a thermostatically controlled gas burner for supplying dry, radiant heat to the bottom wall of the hopper. Each retort tube forms a single pass loop which has a burner installed at one extent thereof and which communicates with an exhaust stack at the opposite extent thereof. In a preferred arrangement, each retort tube is provided in the shape of an inclined U arranged in a plane which is generally parallel to a selected one of the oppositely extending, insulated bottom wall portions of the heating chamber. Each retort tube has a pair of outlets to the exterior of the tank, one of the outlets having the burner mounted therein and the other of the outlets being connected to the exhaust stack.

A damper system is installed in the exhaust stacks for limiting heat loss from the heating chamber. A damper in each exhaust stack remains in the open position while the burners are operating to provide adequate air flow for the burners. A control system monitors an output signal from a thermostat mounted in the heating chamber, and, when the heating chamber has reached a desired temperature, the control system turns off the burners and actuates a solenoid that moves the dampers to a closed position. This prevents heated air from flowing out of the exhaust stacks, retaining heat within the heating chamber.

BRIEF DESCRIPTION OF THE DRAWINGS

The novel features believed to be characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
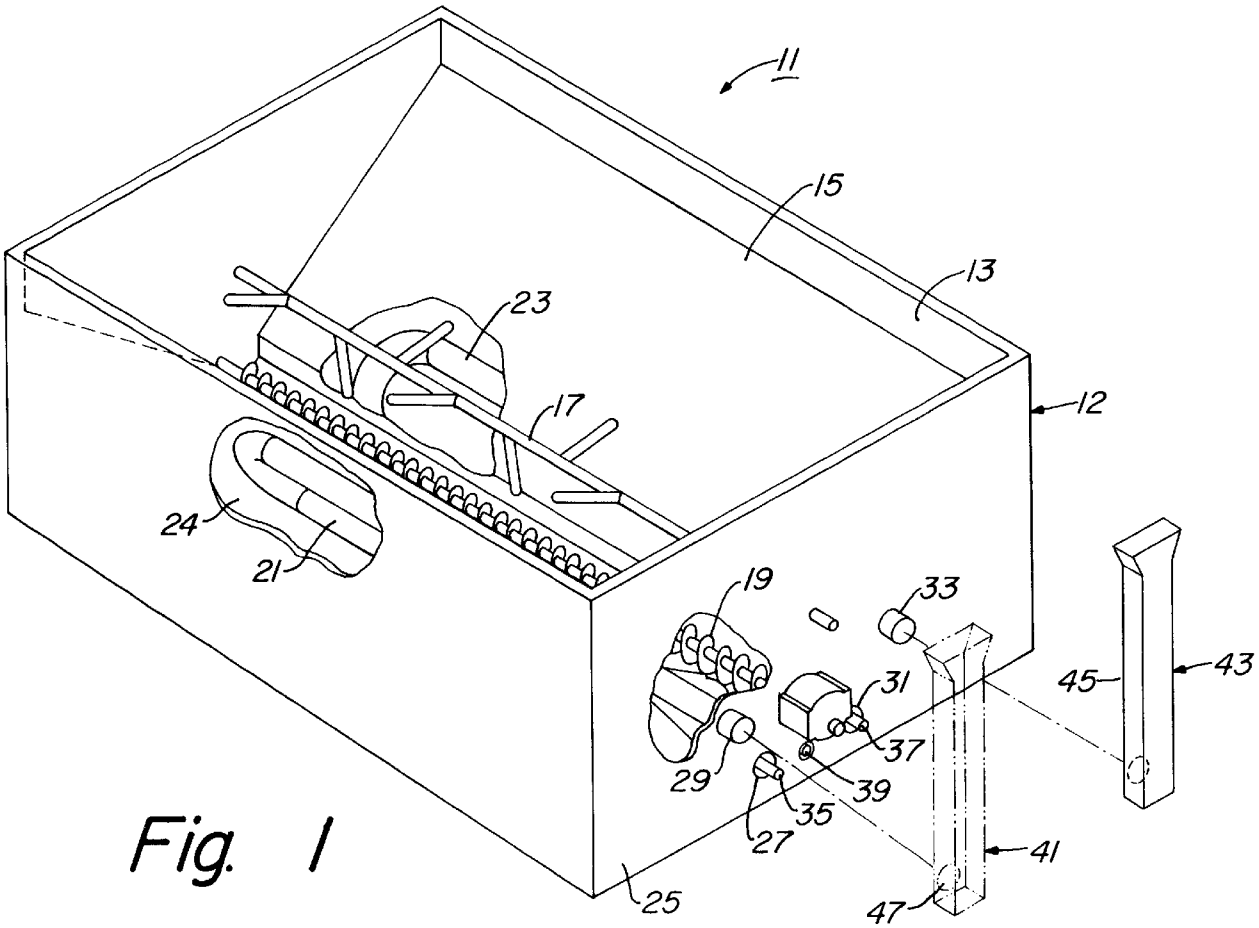
FIG. 1 is a perspective view, partly broken away, of the body of the present invention showing the radiant heat source and exhaust stacks thereof and prior to installation of the damper system.

FIG. 1 shows a portable device 11 used for heating asphalt prior to application of the asphalt to a surface. Device 11 is available commercially under the trademark Pro-Patch from H.D. Industries of Jacksonville, Tex.

Device has a body 12 containing a hopper compartment 13 having a V-shaped bottom wall 15. A paddle shaft 17 is located near a lower portion of bottom wall 15, paddle shaft 17 being rotated to agitate asphalt in hopper 13. Asphalt flows downward in hopper 13 and is dispensed by a screw conveyor 19, which rotates to move portions of asphalt longitudinally and out of hopper 13.

Asphalt in hopper 13 is heated using retort tubes 21, 23 located in a heating chamber 24 under bottom wall 15. Each tube 21, 23 is U-shaped, tubes 21, 23 connecting to an outer wall 25 of device 11 and being in communication with the exterior of device 11. Tube 21 begins at inlet 27 and ends at outlet 29, and tube 23 begins at inlet 31 and ends at outlet 33. Burners 35, 37, preferably for use with propane, are located in inlets 27, 31, respectively, for producing heat within tubes 21, 23, which radiantly heat bottom wall 15. When burners 35, 37 are not operating, an electric heater 39 located in heating chamber 24 may be used to heat bottom wall 15.

Outlets 29, 33 are connected to an inner surface 45 of each exhaust stack 41, 43 at an opening 47 located near the lower end of each stack 41, 43. In this embodiment, exhaust stacks 41, 43 are formed of rectangular metal tubing and are oriented vertically near outer wall 25. Exhaust stacks 41, 43 provide for adequate air flow while burners 35, 37 are operating and provide a path for heat to move from within tubes 21, 23 to the exterior of device 11.

To improve retention of heat within device 11 when burners 35, 37 are not operating, an electronically-controlled damper system is installed in exhaust stacks 41, 43. The damper system is shown partially installed in FIGS. 2 and 3 and fully installed and attached to device 11 in FIG. 5.

Figure 3:
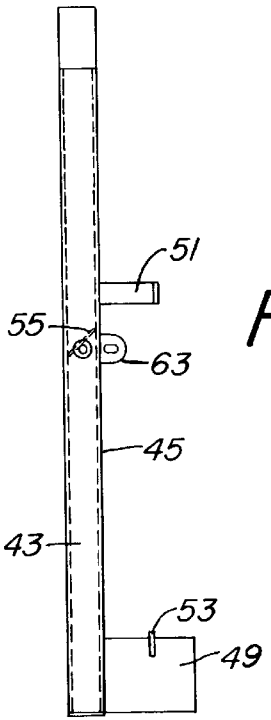
FIG. 3 is a side view of the exhaust stacks of FIG. 2.
Figure 2:
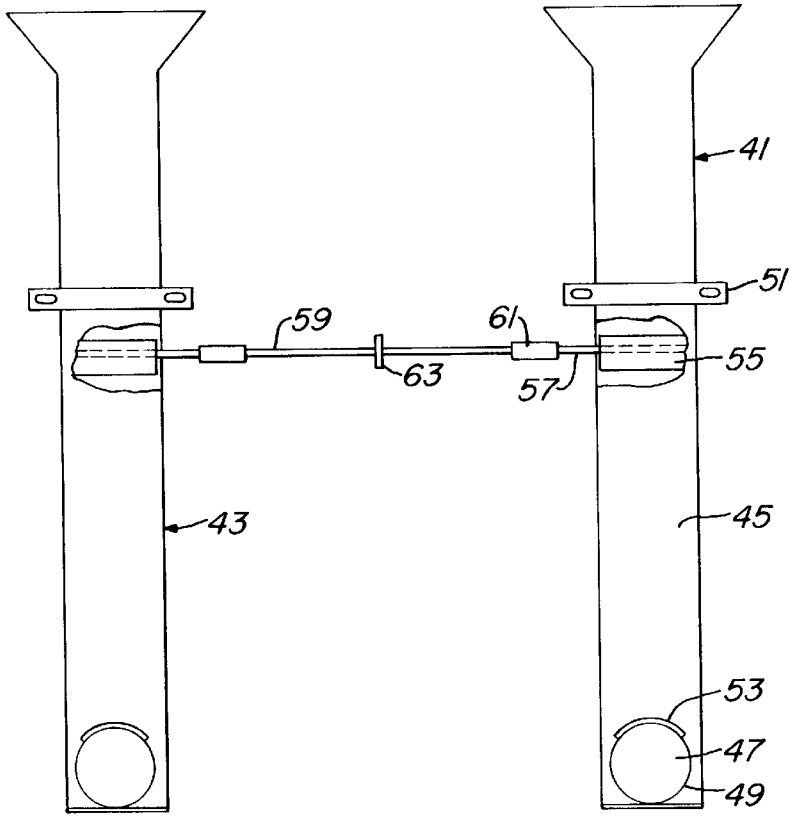
FIG. 2 is a front view, partly broken away, of the exhaust stacks of FIG. 1 with the damper system installed.

Referring to FIGS. 2 and 3, stacks 41, 43 are shown detached from device 11 (FIG. 1). To provide space between inner surface 45 and outer wall 25, an extension 49 is attached to each opening 47 and standoffs 51 are mounted to inner surface 45. Extensions 49 are cylindrical and have a radius approximately equal to that of openings 47 and slightly less than the radius of outlets 29, 33, allowing the ends of extensions 49 to fit within outlets 29, 33. A stop 53 is located on the upper portion of each extension 49 for limiting the amount of extension 49 that can be inserted into outlets 29, 33. In this embodiment, standoffs 51 are formed as rectangular boxes and serve as the upper point for attaching inner surface 45 of exhaust stacks 41, 43 to outer wall 25 (FIG. 1).

Figure 4:
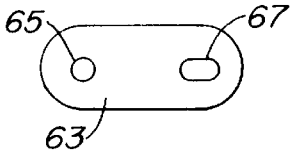
FIG. 4 is a side view of the lever arm of FIG. 2.

A damper 55 is rotatably mounted within each exhaust stack 41, 43 just below standoff 51. Dampers 55 are formed from flat plates and are sized to block the interior of stacks 41, 43 when rotated from a vertical orientation towards a horizontal orientation. Dampers 55 rotate on an axis that is parallel to inner surface 45. A small shaft 57 extends inward from each damper 55, shafts 57 being fixedly attached to dampers 55 and coaxial with the axis of rotation of dampers 55. A central rod 59 is connected at its outer ends to the inner ends of shafts 57 by couplers 61, rotation of rod 59 causing rotation of dampers 55. A lever arm 63 is mounted to a central portion of rod 59. As shown in the profile view of FIG. 4, lever arm 63 has a hole 65 for receiving rod 59 and an elongated hole 67 for connecting lever arm 63 to an actuator.

Figure 5:
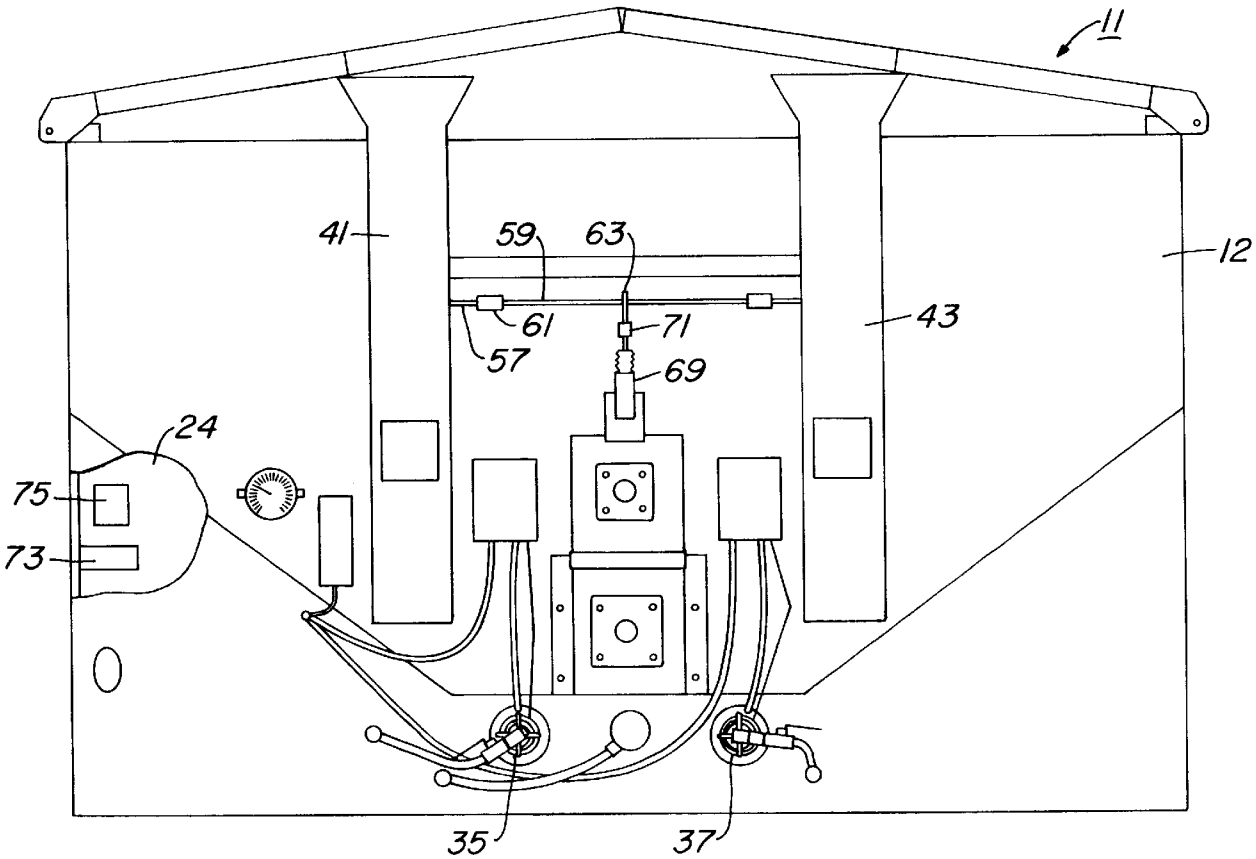
FIG. 5 is a end view of the body of FIG. 1 showing the damper system and exhaust stacks installed.

FIG. 5 shows exhaust stacks 41, 43 and damper system installed on device 11. Rod 59 is connected to shafts 57 with couplers 61, and lever arm 63 is attached to rod 59. A solenoid 69 has a connector 71 and is mounted to body 12. Elongated hole 67 (FIG. 4) of lever arm 63 is rotatably attached to connector 71, allowing solenoid 69 to rotate rod 59 and dampers 55 when solenoid 69 is actuated to move connector 71 vertically.

In addition to the mechanical components, the damper system comprises electrical sensors and control components. A thermostat 73 is mounted within body 12 and near heating chamber 24, thermostat 73 producing an output signal relative to the temperature within heating chamber 24 that is monitored by a control module 75. Control module 75 is also mounted within body 12 and controls the operation of burners 35, 37 and controls solenoid 69 to open and close dampers 55 in response to the output signal from thermostat 73.

Figure 6:
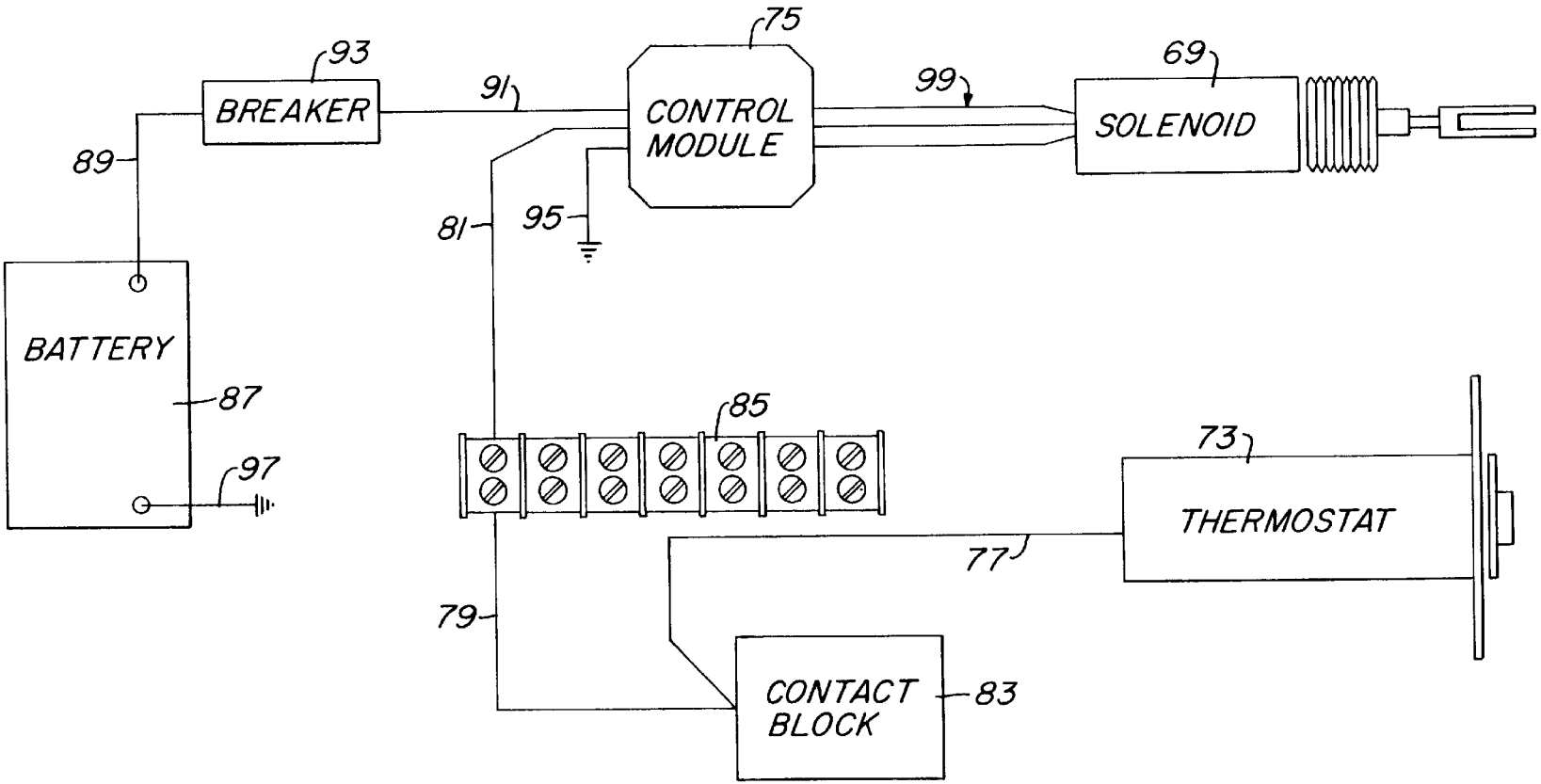
FIG. 6 is a schematic view of the electronic control system of the present invention.

FIG. 6 is a schematic drawing of the electronic controls for the damper system of the preferred embodiment. Thermostat 73 is connected to control module 75 through leads 77, 79, and 81 and through contact block and terminal block 85. To provide power for the electrical components, a battery 87 is connected to control module 75 through leads 89 and 91, with circuit breaker 93 connecting leads 89, 91. Leads 95 and 97 provide for grounding of control module 75 and battery 87, respectively. Wiring harness 99 provides a three-wire connection between solenoid 69 and control module 75.

Referring to the figures, in operation, a volume of asphalt mix materials is placed in hopper compartment 13 to be heated and dispensed for use in repairing an asphalt pavement. When thermostat 73 produces an output signal that indicates a low temperature in heating chamber 24, control module 75 sends electrical signals through wiring harness 99 that cause solenoid 69 to move or remain in an extended position, opening dampers 55 in exhaust stacks 41, 43. Control module 75 also commands burners 35, 37 to begin operation, a flammable gas being injected into burners 35, 37 and ignited. The heat from burners 35, 37 heats retort tubes 21, 23, which begin to radiate heat to the lower surface of bottom wall 15, heating hopper 13 and the asphalt within hopper 13. Since dampers 55 are open, heated air flows out of outlets 29, 33 of retort tubes 21, 23 and through exhaust stacks 41, 43, ensuring adequate air flow for proper functioning of burners 35, 37. When asphalt is heated to a workable state, screw conveyor 19 is rotated to dispense asphalt while paddle shaft 17 rotates to reduce bridging of the asphalt within hopper 13 and ensure a steady supply of asphalt to screw conveyor 19.

When the output signal from thermostat 73 indicates the temperature of heating chamber 24 has reached a desired temperature, control module 75 commands burners 35, 37 to cease operation and commands solenoid 69 to move to a retracted position, closing dampers 55. With dampers 55 closed, heated air is prevented from flowing out of retort tubes 21, 23, limiting heat loss from heating chamber 24. As the temperature in heating chamber 24 decreases to below the desired temperature, control module 75 commands solenoid 69 to reopen the dampers 55 and commands burners 35, 37 to reignite. Dampers 55 also remain closed when electric heater 39 is used to heat heating chamber 24.

While the invention has been shown in only one of its forms, it is not thus limited but is susceptible to various changes and modifications without departing from the spirit thereof.

I claim:

1. A device for transporting asphalt repair materials for use in repairing potholes in asphalt pavements, the device comprising:

a body having a hopper compartment with a V-shaped bottom wall for transporting asphalt mix materials and a generally-V-shaped heating chamber located below the hopper compartment, the V-shaped bottom wall of the hopper compartment defining an upper extent of the heating chamber;

a dry heat means associated with the heating chamber for heating the chamber and for transferring heat to the hopper compartment through the bottom wall, the dry heat means having a pair of oppositely-arranged retort tubes on either side of the V-shaped bottom wall of the hopper, the retort tubes being heated by a least one gas burner for supplying dry, radiant heat to the bottom wall to maintain the asphalt mix materials in a workable state;

an exhaust conduit connected to an outlet of each retort tube for conducting heated air flowing out of the retort tubes;

a damper mounted in each exhaust conduit, the dampers being selectively moveable between an open position, in which heated air can flow through the exhaust conduits, and a closed position, in which heated air is retained in the exhaust conduit for limiting the loss of heat from the heating chamber; and control means for controlling the position of the dampers in response to changes in the temperature of the heating chamber.

2. The device of claim 1, wherein:

the dampers move simultaneously and are oriented to lie in the same plane.

3. The device of claim 1, wherein the control means comprises:

a solenoid connected to the dampers by a connecting linkage, the linkage being actuable to move the dampers between the open and closed positions;

a thermostat in thermal communication with the heating chamber; and a control system for actuating the solenoid in response to an output signal from the thermostat.

4. The device of claim 3, wherein:

the operation of the at least one gas burner is selectively controlled by the control system in response to the output signal from the thermostat.

5. The device of claim 3, wherein:

the dampers are flat plates; and the connecting linkage is formed from a rod fixedly connected to the dampers and a lever arm connected to the rod, the lever arm being rotatably connected to the solenoid for rotating the rod when the solenoid is actuated.

6. The device of claim 1, wherein:

the dampers are flat plates.

7. The device of claim 1, wherein:

the dampers rotate between the open and closed positions.

8. A method for heating asphalt repair materials for use in repairing potholes in asphalt pavements, the method comprising the steps of:

(a) providing a body having a hopper compartment with a V-shaped bottom wall for transporting asphalt mix materials and a generally-V-shaped heating chamber located below the hopper compartment, the V-shaped bottom wall of the hopper compartment defining an upper extent of the heating chamber;

(b) installing a dry heat means within the heating chamber for heating the chamber and for transferring heat to the hopper compartment through the bottom wall, the dry heat means having a pair of oppositely-arranged retort tubes on either side of the V-shaped bottom wall of the hopper, the retort tubes being heated by a least one gas burner for supplying dry, radiant heat to the bottom wall to maintain the asphalt mix materials in a workable state;

(c) locating an exhaust conduit in communication with an outlet of each retort tube for conducting heated air flowing out of the retort tubes;

(d) mounting a damper in each exhaust conduit, the dampers being selectively moveable between an open position, in which heated air can flow through the exhaust conduits, and a closed position, in which heated air is retained in the exhaust conduit for limiting the loss of heat from the heating chamber;

(e) connecting a solenoid to the dampers by means of a connecting linkage, the linkage being actuable to move the dampers between the open and closed positions;

(f) mounting a thermostat in thermal communication with the heating chamber; and (g) providing a control system for actuating the solenoid in response to an output signal from the thermostat.

9. The method of claim 8, further comprising:

using the control system to selectively control the operation of the at least one gas burner in response to the output signal from the thermostat.

10. The method of claim 8, wherein:

the dampers move simultaneously and are oriented to lie in the same plane.

11. The method of claim 8, wherein:

the dampers are flat plates.

12. The device of claim 8, wherein:

the dampers rotate between the open and closed positions.

13. The device of claim 8, wherein:

the dampers are flat plates; and the connecting linkage is formed from a rod fixedly connected to the dampers and a lever arm connected to the rod, the lever arm being rotatably connected to the solenoid for rotating the rod when the solenoid is actuated.

* * * * *